US006511200B2

(12) United States Patent
Matsunaga

(10) Patent No.: US 6,511,200 B2
(45) **Date of Patent: *Jan. 28, 2003**

(54) POWER TOOLS HAVING TIMER DEVICES

(75) Inventor: Yutaka Matsunaga, Yokkaichi (JP)

(73) Assignee: Makita Corporation, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/954,381

(22) Filed: Sep. 12, 2001

(65) Prior Publication Data

US 2002/0048166 A1 Apr. 25, 2002

Related U.S. Application Data

(63) Continuation of application No. 09/605,517, filed on Jun. 28, 2000.

(30) Foreign Application Priority Data

Jul. 13, 1999 (JP) ..... 11-199584

(51) Int. Cl.[7] ..... B25B 23/18

(52) U.S. Cl. ..... 362/119; 362/276; 362/802; 315/360

(58) Field of Search ..... 362/118, 119, 362/120, 253, 276, 802; 315/360

(56) References Cited

U.S. PATENT DOCUMENTS

| | | | | |
|---|---|---|---|---|
| 2,310,166 A | | 2/1943 | Way | 362/119 |
| 2,525,568 A | | 10/1950 | Cameron et al. | 362/119 |
| 2,822,615 A | | 2/1958 | Durst et al. | |
| 3,919,541 A | | 11/1975 | Chao | 240/6.46 |
| 3,977,278 A | | 8/1976 | Jackson | 81/57.11 |
| 4,513,381 A | * | 4/1985 | Houser et al. | 318/571 |
| 4,587,459 A | | 5/1986 | Blake | 315/158 |
| 5,169,225 A | | 12/1992 | Palm | 362/118 |
| 5,473,519 A | | 12/1995 | McCallops et al. | 362/120 |
| 5,530,301 A | | 6/1996 | Fu et al. | 307/141 |
| 6,318,874 B1 | * | 11/2001 | Matsunaga | 362/119 |

FOREIGN PATENT DOCUMENTS

| | | | |
|---|---|---|---|
| DE | 2529668 | 1/1977 | B23B/45/02 |
| DE | 85 21 614.3 | 2/1986 | |
| DE | 3738563 | 5/1989 | |
| DE | 3831 344 A | 3/1990 | |
| DE | 3831 344 C2 | 10/1993 | |
| FR | 2523891 | 9/1983 | B24B/23/00 |
| GB | 2305128 A | 4/1997 | A63B/43/06 |
| JP | 2512328 | 7/1996 | |
| WO | WO 99/02310 | 1/1999 | |

OTHER PUBLICATIONS

European Search Report, Oct 20, 2000.
English Abstract of DE 3831 344, Mar. 22, 1990.
U.S. patent application Ser. No. 09/628,928.

* cited by examiner

*Primary Examiner*—Sandra O'Shea
*Assistant Examiner*—John Anthony Ward
(74) *Attorney, Agent, or Firm*—Orrick, Herrington & Sutcliffe, LLP

(57) ABSTRACT

Power tools are taught having a motor M1, a tool 1 coupled to the motor M1 via a tool holder 2, at least one light 4 disposed proximal to the tool 1, a switch 6 coupled to the motor M1 and the light 4, the switch 6 being capable of activation by an operator, a power supply 7 coupled to the switch 6, and a timer circuit 3 coupled to the light 4, the switch 6 and the power supply 7. Preferably, activation of the switch 6 causes the motor M1 and the light 4 to operate and the timer circuit 3 causes the light 4 to remain lit for a predetermined amount of time after either (1) the switch 6 has been activated or (2) the switch 6 has been deactivated subsequent to being activated. The timer circuit 3 can be, for example, a RC timer circuit 11 or a microprocessor 15. The light 4 may be an LED. The power supply 7 can be a rechargeable battery Ba.

26 Claims, 6 Drawing Sheets

POWER TOOLS HAVING TIMER DEVICES

RELATED APPLICATIONS

This application is a continuation of Ser. No. 09/605,517, filed Jun. 28, 2000.

BACKGROUND OF THE INVENTION

1. Field of the Invention

The present invention relates to power tools having lights and methods for operating such power tools. More particularly, the present invention relates to power tools having lights that can light a work area and are more convenient to use than known power tools.

2. Description of the Related Art

Known power tools having lighting devices generally provide a light that operates separately from the tool. That is, the lighting circuit is electrically separate from the motor operation circuit and thus, the light can be turned on even when the tool is not being used. Thus, if the power tool is powered by rechargeable batteries and the light is left on when the power tool is not being used, the rechargeable batteries may be completely discharged and possibly permanently damaged.

FIG. 9 shows a circuit taught by German Patent No. DE 3831344 C2 to control the operation of a light 34 for another type of power tool, in which the lighting circuit and the motor 18 can be operated by a single switch. This known power tool has a switch 76 that can be pushed by the user to activate the motor 18 and the same switch 76 also can control the light. Specifically, according to this German reference, switch 76 is a two-stage push switch.

If the switch 76 is pushed to an intermediate position, the lighting contact S1 will close (on state) and the light 34 will turn on. The motor contact S2 is open (off state), such that the motor 18 does not operate while the switch 76 is in the intermediate position. Therefore, the user can utilize the light in a manner similar to a flashlight in order to position the power tool with respect to the work piece (i.e., a board) while the motor 18 is stopped.

If the two-stage switch 76 is pushed further, the motor contact S2 will close (on state) and thus, the motor 18 will begin to rotate. As a result, the user can begin performing the intended power tool operation, such as driving a screw using a powered screwdriver.

A timer circuit 102 is provided to turn off the light 34 after a predetermined period of time. Thus, the user is not required to manually turn off the light. This timer circuit 102 starts the timing operation when the motor contact S2 closes (i.e. beginning of the motor on state) and opens (i.e. disconnects) the second lighting contact K1 after the predetermined period of time has passed, thereby turning off the light 34. German Patent No. DE 3831344 C2 also describes another design in which the timer circuit 102 starts the timing operation when the lighting contact S1 is closed (turned on). Thus, the light 34 can be turned off either (1) after a pre-determined period of time has passed since the motor 18 began to rotate or (2) after a pre-determined period of time has passed since the light 34 was turned on. As a result, the light 34 will automatically turn off and the user is not required to manually turn off the light 34.

In this known power tool, the switch 76 must be pressed to the intermediate position in order to maintain the light 34 in the on state. Therefore, the operator must adjust the position of the power tool and/or workpiece while holding the switch 76 in the intermediate position. In other words, the user can not remove his/her finger from the switch while adjusting the position and angle of the power tool and/or work. Therefore, the user's hand may become fatigued if repeated screw-driving operations are required.

If the stroke length of the switch 76 is long, it may be easier to hold the switch in an intermediate position in order to turn on the light 34 while preventing the motor 18 from unintentionally starting. However, the user must move his or her finger over a longer range of motion during the lighting and screw-driving operations, thereby causing fatigue. On the other hand, if the stroke length of the switch 76 is short, it may be easier to start the power tool operation, but it may become more difficult to hold the switch in the intermediate position in order to light the work area before being the power tool operation.

Furthermore, the known power tool requires a two-stage push-type switching device and cannot use a common, inexpensive single stage on-off switching device, thereby raising manufacturing costs.

SUMMARY OF THE INVENTION

It is an object of the present invention to teach improved power tools having lighting devices that are easy to operate and can be manufactured with common, inexpensive on-off switching devices.

It is another object of the present invention to teach methods for using such easily operated power tools having lighting devices.

In one aspect, power tools are taught that have a lighting circuit, in which the light and the power tool motor are simultaneously turned on by a single switch. Thus, if the operation of the motor is initiated, the light will turn on. Preferably, a timer is provided to turn off the light at a predetermined time either (1) after the time in which the switch was initially closed (i.e., the on state was initiated) or (2) after the time in which the switch was opened after the motor has started to rotate.

Such power tools can use common, inexpensive, one-stage on-off switches, thereby reducing manufacturing costs. Also, if the present teachings are utilized in a "cordless" power tool (e.g., battery operated tool), the operator is prevented from forgetting to turn off the light and possibly damaging rechargeable batteries, because power tools according to the present teachings will automatically turn off the light.

Because both the motor and light are simultaneously operated, the motor will begin to rotate at the same or substantially the same time that the light turns on. In fact, power tools may be designed such that the light can not be turned on without starting the motor. In such a design, once the switch has been activated in order to simultaneously start both the motor and the light, the switch can be returned to the off position. Returning the switch to the off position will cause the motor to stop, but the light will continue to shine, because a timer is provided. Preferably, the timer is constructed such that the operator can adjust the delay time before the light turns off, so that the operator can determine the appropriate amount of time for the light to remain on after the motor has stopped. The position and angle of the power tool and/or workpiece can thus be adjusted using the light of such a power tool while the motor is stopped. Therefore, such power tools are very convenient and easy to operate.

If the operator is not ready to perform the intended power tool operation when the light is first turned on, the operator can press the switch for a short time in order to turn on the light and then promptly release (turn off) the switch. In such case, even though the switch is in the off position, the light will continue to shine for a predetermined period of time. The operator can therefore adjust the position and angle of the power tool and/or workpiece using the light, but without further operating the motor. After adjusting the position and angle of the power tool, the operator can turn on the motor by pressing the switch again and can use the power tool to perform the desired operation.

According to the present teachings, the operator is not required to move the switch to an intermediate position, thereby simplifying the lighting operation and reducing fatigue. Also, the operator can adjust the position and angle of the power tool and/or work without having to further operate the switch. Thus, such tools are easy to use and inexpensive to manufacture.

In another aspect of the present teaching, the operator preferably can adjust the length of time that the light remains on after the switch has been closed (on state) and then opened (off state). Naturally, if the operator can adjust the delay time, the operator can utilize an optimal time period for operating the light for each particular project and can reduce or prevent wasted power consumption from unnecessary use of the light.

Other objects, features and advantages of the present invention will be readily understood after reading the following detailed description together with the accompanying drawings and the claims.

DETAILED DESCRIPTION OF THE INVENTION

Figure 7:
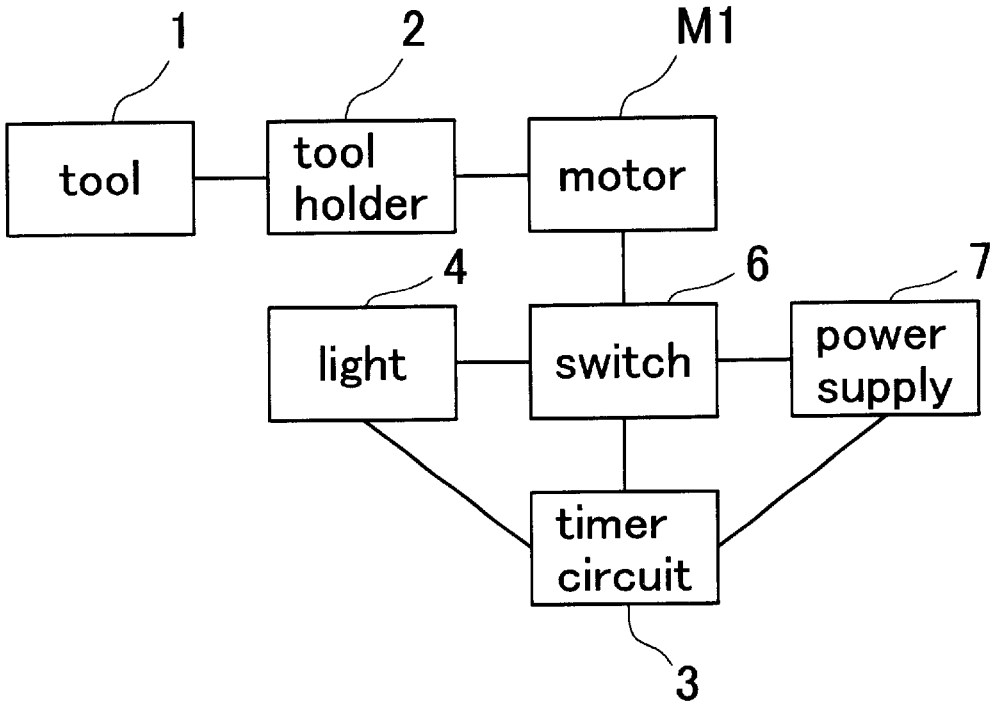
FIG. 7 shows a block diagram of a representative power tool.

As shown in FIG. 7, power tools according to the present teachings may have a motor M1, a tool 1 coupled to the motor M1, optionally via a tool holder 2, a switch 6 that allows the operator to control the operation of the motor M1 and a power supply 7 coupled to the switch 6 to provide power to the motor M1. Such power tools also may include one or more lights 4 disposed at a position that is close to the tool 1, so that illumination can be provided in the direction of an intended power tool operation. The switch 6 coupled to the motor M1 is also preferably coupled to the light 4.

In one aspect of the present teachings, a timer circuit 3 can be coupled to the light 4, the switch 6 and the power supply 7. Preferably, activation of the switch 6 (i.e., the "closed" or "on" state of the switch 6) can cause the motor M1 and the light 4 to simultaneously operate. However, when the switch 6 is deactivated (i.e., the "open" or "off" state of the switch 6), the motor M1 will promptly stop, but the light 4 will continue to shine, due to the timer circuit 3. Preferably, the light 4 will turned off after a predetermined time delay from the time that the switch 6 was activated (switch on state) or deactivated (switch off state). Preferably, the operator can adjust the timer circuit 3, such that the operator can select an appropriate time delay for operating the light 4 while the motor M1 is stopped.

The timer circuit 3 may be constructed according to a variety of designs. For example, the timer may utilize one or more varistors, capacitors and/or transistors to perform the timing operation. Alternatively, a microprocessor may be utilized to perform the timing operation. Digital or analog timer circuits may be utilized with the present teachings.

In another aspect of the present teachings, the timer circuit 3 is constructed so as to begin the timing operation after the switch 6 has been deactivated, subsequent to an activation of the switch. That is, although the timer circuit 3 detects when the switch 6 is activated, the timing operation is not started when the switch 6 is activated. Instead, the timing period is initiated when the switch 6 is subsequently returned to the off state (deactivated). This design is particularly advantageous to reduce the number of times that the operator must operate the switch 6 while using the light 4 of the power tool to illuminate the work area. Moreover, this design ensures that the light 4 will not turn off while the intended power tool operation is being performed.

For example, according to this design, the power tool may be operated as follows. When the operator first wishes to illuminate a workpiece or work area, the operator can activate the switch 6, thereby starting the motor M1 and turning on the light 4. The operator then deactivates the switch 6 to stop the motor M1 and the light 4 will remain turned on for a predetermined amount of time after the switch 6 was deactivated. While the light 4 is shining, the operator can adjust the position of the power tool and/or workpiece and then begin the intended power tool operation. Because the timer circuit 3 will initiate the timing operation only upon deactivation of the switch 6, the light 4 will remain lit, regardless of the length of time that the intended power tool operation is performed, because the switch 6 is in the activated or on state throughout the intended power tool operation. Further, after the intended power tool operation is completed, the light 4 will continue to shine for a predetermined amount of time after the operation was completed. During this time, the operator can again adjust the position of the power tool and/or workpiece in order to prepare for the next power tool operation. Importantly, the operator is not required to activate the switch 6 again and thereby start the motor M1, unless the position adjustment operation takes longer than the predetermined period of time to perform. Thus, this design will increase the ease of use and reduce power consumption of power tools. Because the operator is not required to start the power tool motor M1 in order to turn on the light 4, this design is particularly useful for cordless power tools.

Optionally, the timer circuit 3 also may be adjustable by the operator, such that the operator can adjust the delay time before the light will turn off. Thus, in such case, the operator can select an optimal delay time according to the pace or speed at which the operator is adjusting the position of the power tool and/or workpiece between each power tool operation. Thus, if the operator requires a significant amount of time to adjust the position of the power tool and/or workpiece between each power tool operation, the operator can optionally increase the timer delay time. In this case, the light 4 will continue to shine during the entire position adjustment period without having to activate the switch 6, and thereby the motor, until the operator is ready to perform the next power tool operation. On the other hand, if the operator is rapidly adjusting the position of the power tool and/or workpiece between each power tool operation, the delay time optionally may be reduced in order to conserve power. Thus, this design may further permit the operator to minimize the waste of energy, which is particularly important for cordless power tools.

Although the present teachings can be applied to any kind of power tool, the present teachings are particularly useful with power tools that are operated with rechargeable batteries. Further, although any light source may be utilized, preferably light emitting diodes (LEDs) are utilized at the light source. Moreover, although a variety of switching devices can be utilized according to the present teachings, preferably a one-stage, on-off switching device is utilized in order to reduce manufacturing costs.

Power tools according to the present invention optionally can be operated in the following manner. First, the operator activates (turns on) the switch 6 for a short time and then promptly deactivates (turns off) the switch, whereby the light 4 remains on, but the motor M1 stops. While the light 4 is turned on but the switch 6 is in the off state, the operator can adjust the position and/or angle of the power tool and/or workpiece. After satisfactorily adjusting the power tool and/or workpiece, the operator again activates the switch 6 in order to perform the intended power tool operation. More preferably, after using the power tool and determining the pace at which the operator is working, the operator may adjust the delay time of the timer circuit 3 to suit the operator's needs.

Each of the additional features and method steps disclosed above and below may be utilized separately or in conjunction with other features and method steps to provide improved power tools and methods for making and using the same. Representative examples of the present teachings, which examples will be described below, utilize many of these additional features and method steps in conjunction. However, this detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the present teachings in the broadest sense, and are instead taught merely to particularly describe representative and preferred embodiments of the present teachings, which will be explained below in further detail with reference to the figures.

Figure 1:
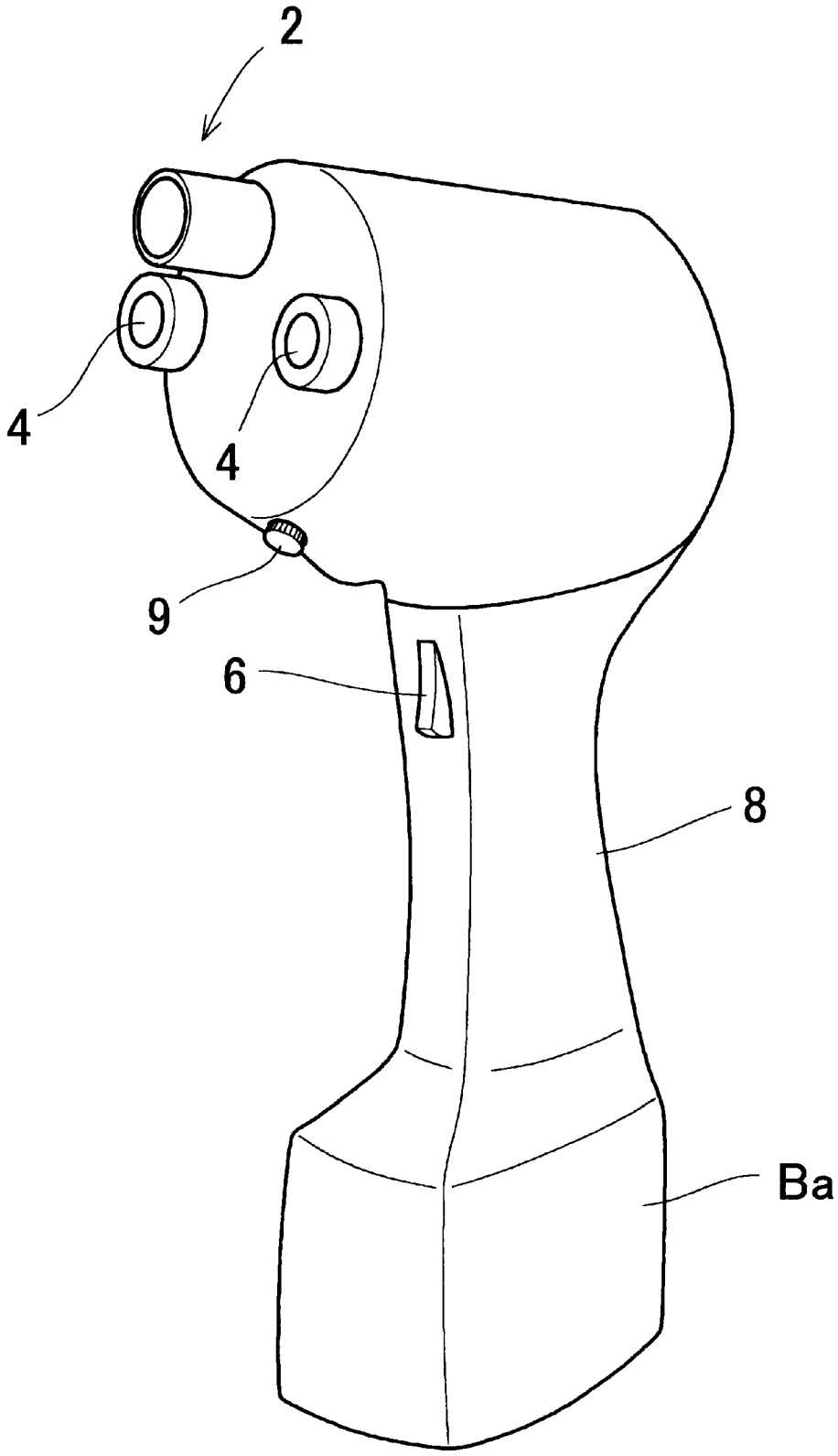
FIG. 1 is an external perspective view of a representative power tool.
Figure 2:
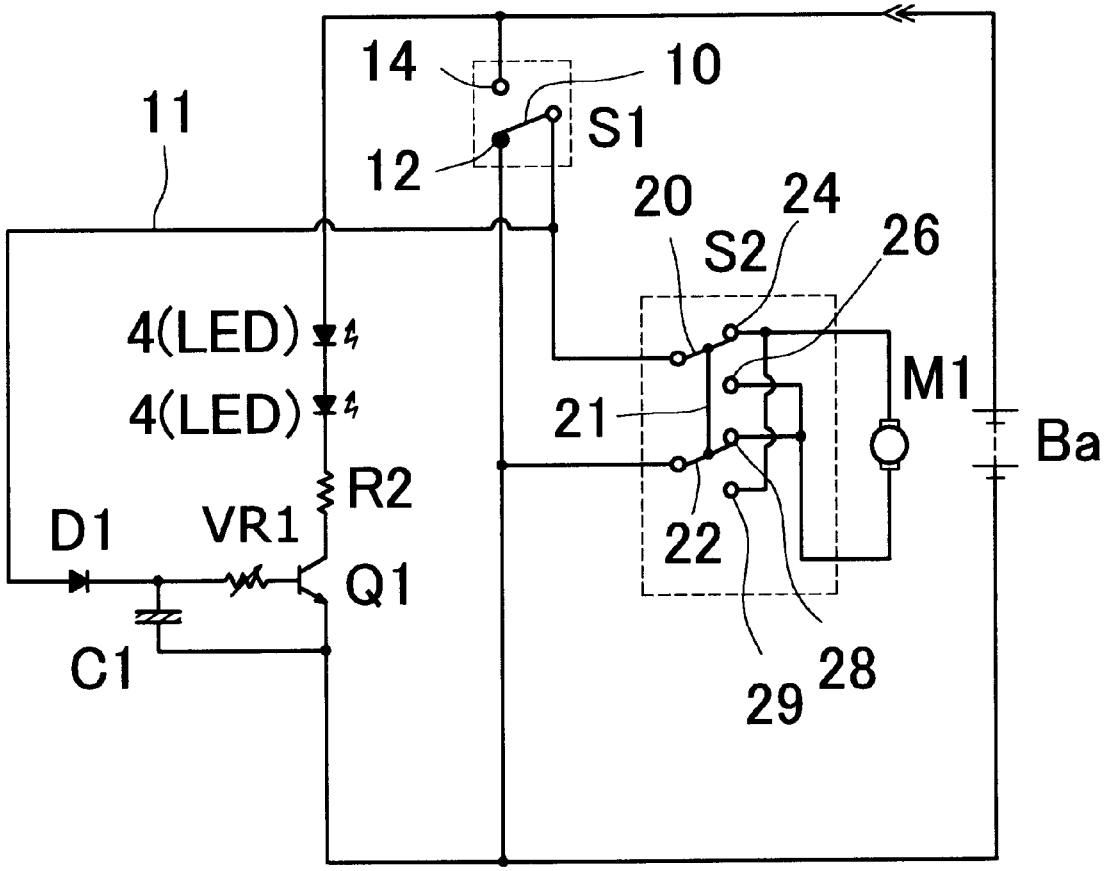
FIG. 2 is a diagram of a representative electrical circuit that can be utilized with the representative power tool shown in FIG. 1.

As an example of the present teachings, FIG. 1 shows a representative example of the exterior of a power screwdriver that can be optionally powered with rechargeable batteries Ba. This representative power screwdriver has a screwdriver bit holder 2 that is driven by an enclosed motor, a pair of lights 4, a switch 6, a timer adjusting switch 9 and a handle 8 for holding the power tool. FIG. 2 shows a representative electrical circuit that can be used with the representative power tool of FIG. 1.

A representative method for operating this power tool will be described with reference to FIGS. 1 and 2. The operator can use his/her finger to press switch 6, which may preferably be a one stage, on/off, trigger switch, toward the handle 8. Thus, power is supplied from the battery Ba to the motor M1 and the motor M1 will begin to rotate. Consequently, the screwdriver bit holder 2 also begins to rotate and the lights 4 are turned on.

An elastic body, such as a spring (not shown), may be disposed within the handle 8 to outwardly bias the switch 6. Thus, when pressure on the switch 6 is removed or relaxed, the switch returns to the open or off state, thereby deactivating the switch 6 and cutting off power to the motor M1. As a result, the motor M1 and the screwdriver bit holder 2 will stop when pressure on the switch 6 is released or removed. Preferably, the lights 4 will turn off a predetermined time after the pressure on the switch 6 is released or removed.

In FIG. 2, S1 represents a common, one-stage, on-off switching device that can operate as follows. When switch 6 is pushed towards the handle 8, the movable switch 10 moves towards and ultimately contacts node 14. On the other hand, when switch 6 returns to its outermost position, the movable switch 10 moves towards and contacts node 12, as a result of the biasing forces of the elastic means (i.e., the switch 6 is pushed out and away from handle 8 because pressure on the switch 6 has been released).

Furthermore, in FIG. 2, S2 represents a common forward-reverse changeover switch, which comprises a pair of movable switches 20 and 22 that are joined by an insulating connecting element 21. The motor M1 can rotate in both forward (clockwise) and reverse (counterclockwise) directions depending upon the state of the forward-reverse changeover switch S2. Thus, when the movable switches 20 and 22 contact nodes 24 and 28, respectively, motor M1 rotates in the forward direction. On the other hand, when the movable switches 20 and 22 contact nodes 26 and 29, respectively, motor M rotates in the reverse direction.

When the operator presses the switch 6 towards the handle 8, the movable switch 10 contacts node 14 and power from the battery Ba is supplied to the motor M1. Therefore, the motor M1 will rotate in either the forward or reverse direction depending on the state of the forward-reverse changeover switch S2. When the operator removes or relaxes his/her finger from the switch 6, the movable switch 10 will contact node 12, thereby forming a short circuit for the motor M1. Consequently, a rheostatic braking effect is generated in the motor M1 and the motor M1 rapidly stops rotating. Appropriate rheostatic braking circuits are well known in the art and need not be repeated herein.

A representative circuit for operating the lights 4 will now be explained. Preferably, the lights 4 are a pair of LEDs, which can be connected in series to battery Ba via resistor R2 and transistor Q1. Varistor VR1 is preferably connected to the base of transistor Q1 and capacitor C1 is preferably connected between varistor VR1 and the emitter of transistor Q1.

Transistor Q1 is preferably in the off state when the voltage across capacitor C1 is below the threshold voltage of transistor Q1. In the off state, current does not flow to the pair of LEDs 4 and thus, the LEDs 4 are not lit. On the other hand, if the voltage across capacitor C1 is higher than the threshold voltage of transistor 01, the transistor Q1 is biased to the on state and current will flow to the pair of LEDs 4, thereby turning on the LEDs 4.

Capacitor C1 will be charged according to circuit 11 when switch 6 is pressed to move the on-off switch S1 to the on state (i.e., the movable switch 10 is contacting node 14). Diode D1 is preferably provided to prevent reverse current flow.

While the movable switch 10 is contacting node 14, the capacitor C1 preferably charges to at least the threshold voltage of transistor Q1. At the same time, transistor Q1 is biased on, thereby allowing current to flow to turn on the LEDs 4. Preferably, the capacitance of the capacitor C1 is relatively low. In that case, the capacitor will quickly charge to the threshold voltage and the operator will recognize that the lights 4 turn on approximately at the same time that the switch 6 is activated.

When the pressure on switch 6 is removed or relaxed, the movable switch 10 of the on-off switching device S1 moves to contact node 12. As a result, current flow to capacitor C1 stops and the energy in capacitor C1 discharges via the resistance of varistor VR1. When the voltage across capacitor C1 drops below the threshold voltage of transistor Q1, transistor Q1 will turn off, thereby stopping the supply of power from the battery Ba to the LEDs 4. Thus, the lights 4 will turn off. In other words, in the present representative embodiment, the timer circuit for operating the lights 4 is designed to provide a predetermined time delay after the operator stops putting pressure on switch 6. The size of capacitor C1 and the resistance of varistor VR1 determine this predetermined time delay. Such "RC timer circuits" are well known in the art and other appropriate RC timer circuits can be easily designed according the present teachings in order to suit the designer's needs.

Accordingly, the amount of time that is necessary to discharge the energy stored in capacitor C1, such that the voltage across capacitor C1 will fall below the threshold voltage of transistor Q1, depends upon the resistance of varistor VR1. Therefore, preferably the operator can adjust the resistance of the varistor VR1 by turning the knob 9 (see FIG. 1) located on the outside of the handle 8 in order to adjust the delay period.

Figure 3:
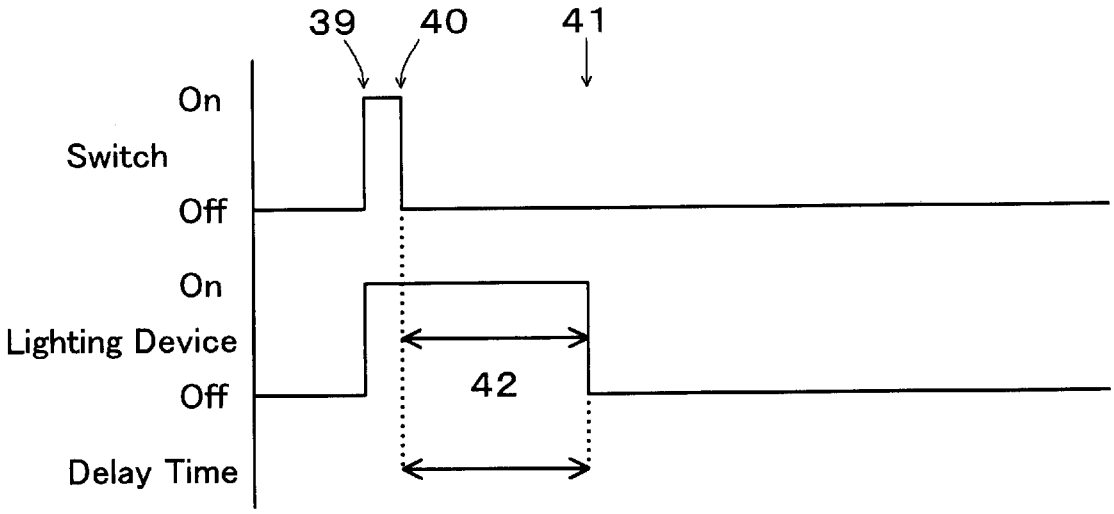
FIG. 3 is a diagram showing a preferred relationship between the switch operation, the light being turned on and off and the delay time.

A representative method for using this representative power tool will be explained with reference to FIG. 3. If the operator is having a difficult time while adjusting the position and angle of the power tool and/or workpiece between power tool operations (e.g., because the work area is dimly lit), the operator can briefly activate switch 6 at time 39, as shown in FIG. 3. The motor on state operation is terminated at time 40 by releasing the pressure applied to switch 6. Thus, while motor M1 will start rotating at time 39, motor M1 rapidly stops rotating after time 40, because motor M1 has not attained significant acceleration when the pressure on switch 6 is released.

At approximately time 39, the lights 4 also will turn on. However, the lights 4 will turn off after a longer period of time (i.e., at time 41), due to the charge stored on capacitor C1. As a result, as shown in FIG. 3, the light will shine until being turned off at time 41. In other words, the state in which the motor M1 is stopped and the light 4 shines starts approximately at time 40 and ends at time 41. Moreover, the operator is not required to perform any further operation for that state to continue, because the light will continue to shine until time 41, even if switch 6 is not activated again during period 42. Therefore, during period 42, the operator can concentrate on adjusting the position and angle of the power tool and/or workpiece without paying attention to the operation of the switch 6. Thus, this operation is very simple compared to the case of the known lighted power tool described in FIG. 9, in which adjustments must be made while the switch is held in an intermediate position.

Figure 4:
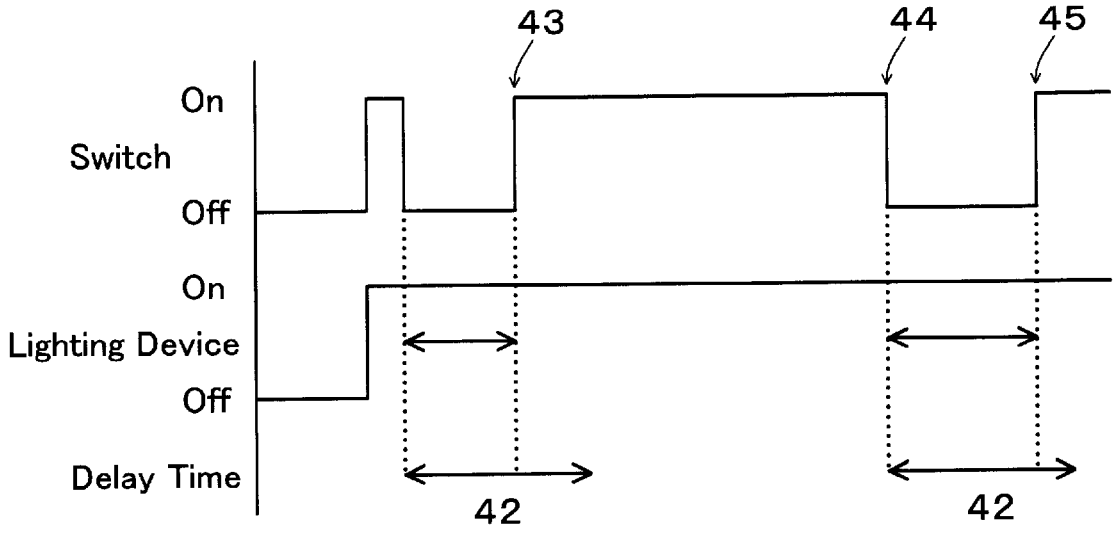
FIG. 4 is a diagram showing a preferred relationship between the switch operation, the light being turned on and off and the delay time during an actual operation.

FIG. 4 shows a representative example of an actual operation of the representative power screwdriver. In this case, the position and angle of the power tool and/or workpiece are adjusted in order to perform screw-driving operations. The driving position for the screw set in the driver bit is determined during period 42, in which the light has been turned on by briefly activating switch 6 such the motor is stopped and the light is on. While the light continues to shine, the switch 6 is again activated (at time 43) by pressing the switch 6 against the handle 8 until the screw driving operation has been completed (time 44). At that time, the switch activation state (on state) is terminated (i.e. the motor is stopped) as shown at time 44 in FIG. 4.

According to the present teachings, even though the motor M1 rapidly stops rotating, the lights 4 remain on during period 42, which time period is necessary for the capacitor C1 to discharge below the threshold voltage of transistor Q1. If the necessary adjustments to the position and angle for the next screw-driving operation can be made during this period 42, the switch 6 may be pressed again at time 45 to begin the screw-driving operation. In that case, the short on-off operation shown at times 39 and 40 is not necessary to turn on the light. In this embodiment, the lights 4 will turn off a predetermined time after the switch 6 has returned to the off state (off position). Moreover, this delay time is preferably chosen to be slightly longer than the time necessary to adjust the power tool position for the next screw driving operation. In this representative embodiment, the delay time can be optimally adjusted to suit the work at hand, because the operator can adjust this delay time.

Of course, if the position cannot be adequately adjusted within period 42 and the lights 4 must be turned on again, switch 6 can be briefly activated again in order to turn on the lights 4. In the alternative, the operator can adjust knob 9 to increase the delay time before the lights 4 are turned off.

Figure 5:
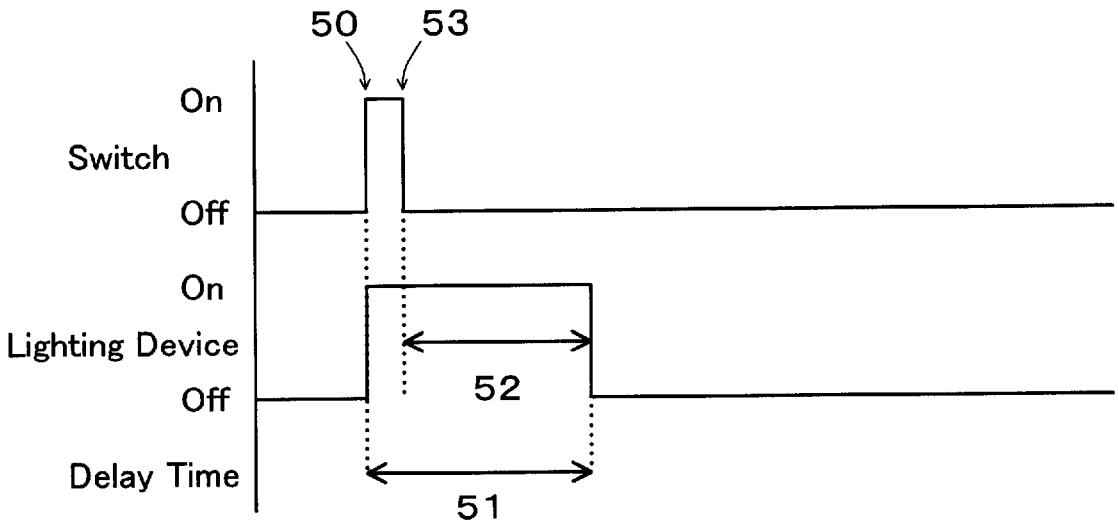
FIG. 5 is a diagram showing another preferred relationship between the switch operation, the light being turned on and off and the delay time.

While the representative embodiment describes a mode in which the light 4 is turned off after a delay from the off operation of the switch 6, the power tool may have a mode in which the light is turned off after a delay from the on operation of the switch 6. As shown in FIG. 5, the power tool can be constructed such that the light 4 shines during time period 51, which begins at time 50 (by activating switch 6) and ends at time 52. During time period 52, motor M1 is stopped and the lights 4 are turned on. The operator can use period 52 to adjust the position of the power tool and/or workpiece.

Figure 6:
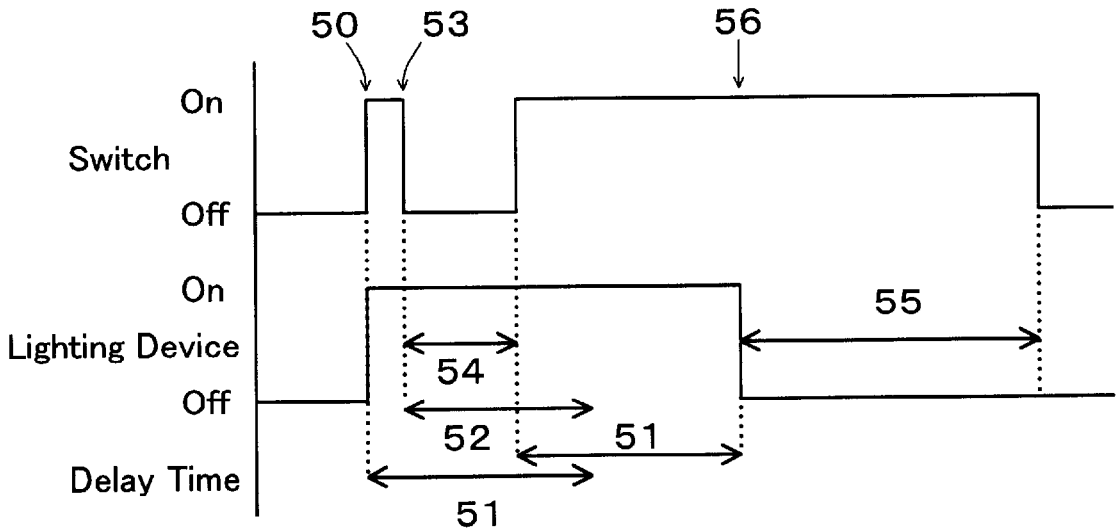
FIG. 6 is a diagram showing another preferred relationship between the switch operation, the light being turned on and off and the delay time during an actual operation.

FIG. 6 shows a representative example of the mode of FIG. 5 in actual operation. Position adjustment may be completed and the actual screw driving operation can begin in the lit state if the position adjustment period 54 is completed within period 52. The lights 4 turn off (time 56) when the time delay 51 from the start of the screw-driving operation is completed.

This embodiment is appropriate for situations in which lighting is necessary during the position adjustment operation, but not during the actual screw driving operation. In this case, the light is turned off during the period shown by period 55 and wasted lighting and wasted power consumption can be prevented.

Figure 9:
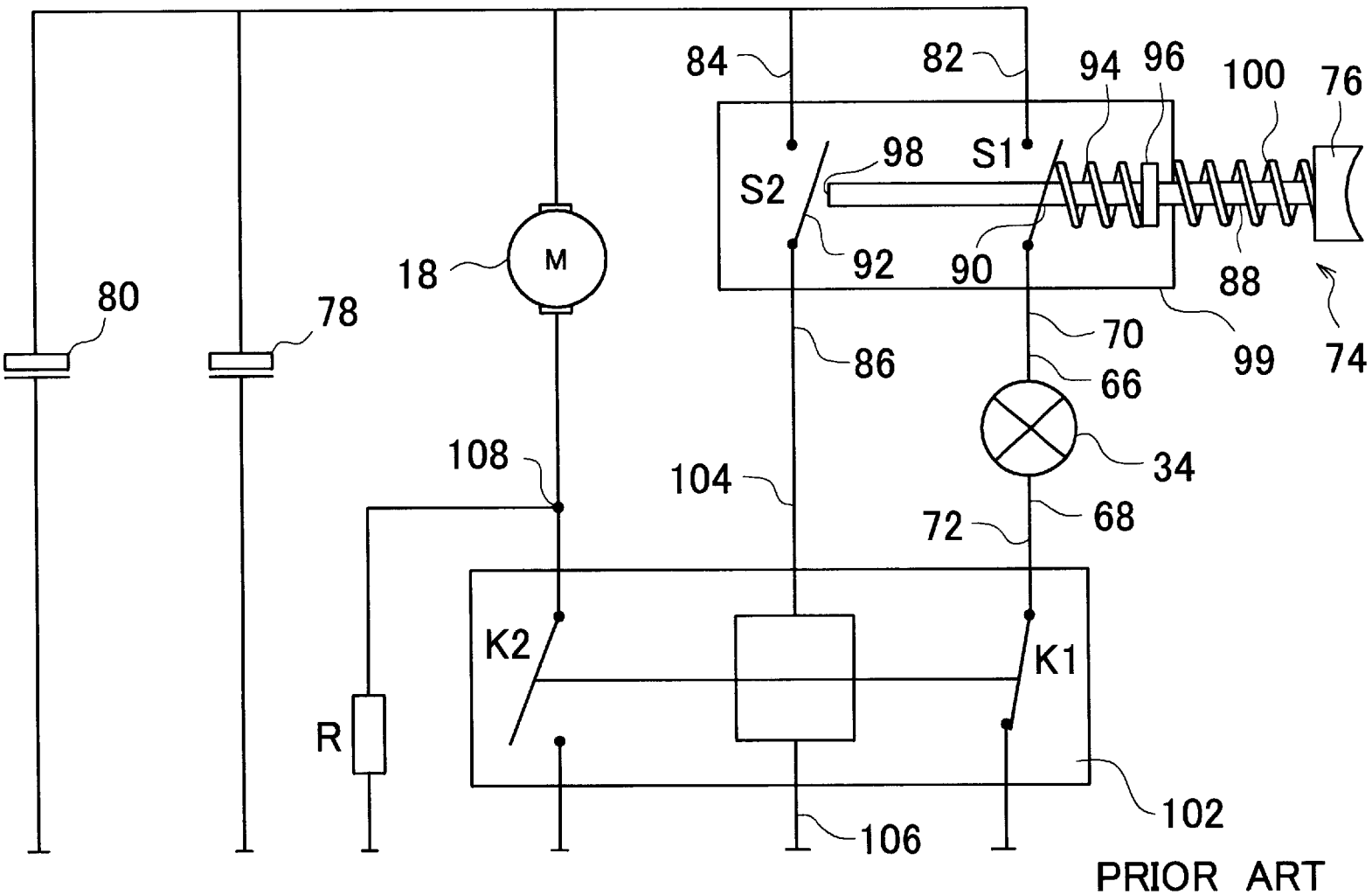
PRIOR ART FIG. 9
FIG. 9 is a diagram showing a lighting/motor operation circuit of a known power tool.

Moreover, the circuit for turning off the light after a predetermined time delay from the time when the switch is turned on can be constituted using the timer 102 shown in FIG. 9. This timer 102 starts timing when the switch S2 is moved to the on position and, after counting up to a predetermined time, the timer 102 turns off the switch K1 and turns off the light.

Figure 8:
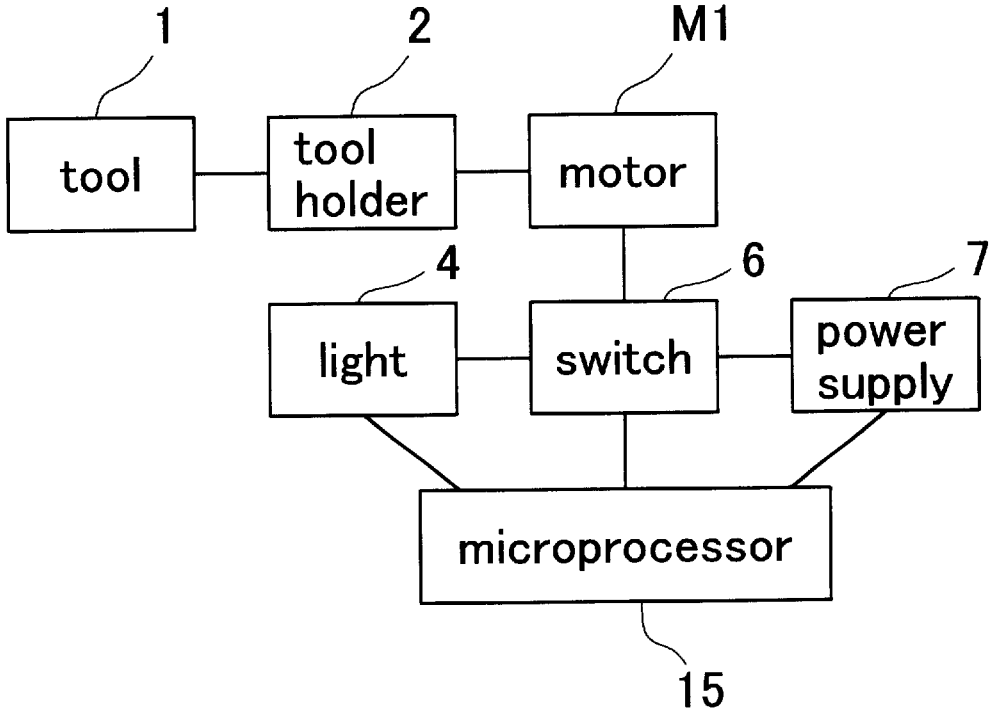
FIG. 8 shows a block diagram of a representative power tool having a microprocessor to perform the timing function.

The power tool also may include a microcomputer or microprocessor to perform the time delay function. FIG. 8 shows a representative power tool in which the microprocessor 15 controls the operation of the light. In this case, a control program may be programmed into the microcomputer 15 and a circuit can be realized such that the light 4 is turned off after a predetermined delay time from the time when the switch 6 is turned on or is turned off. Naturally, other types of analog or digital timer circuits can be utilized with the present teachings and the specific embodiments described herein are merely representative embodiments.

Thus, easy to use power tools having lighting devices can be inexpensively manufactured using common, inexpensive on-off switching devices. Further, the present power tools provide light while the motor is stopped by means of a simple, short on-off operation, thereby further simplifying the position adjusting operation.

Although the representative embodiment describes an application of the present teachings to an electric screwdriver, the present teachings can also be applied to a wide variety of power tools, including but not limited to electric saws, electric drills and the like. Further, although two lights were provided in the representative embodiment, any number of lights may be utilized.

What is claimed is:

1. A power tool comprising:

a tool housing, a motor disposed within the tool housing, a light source disposed on the tool housing, a switch coupled to the motor and the light source, the switch being capable of activation and deactivation by an operator, and a timer circuit coupled to the light source, the switch and a power supply, wherein when the power tool is activated or deactivated the light source remains on for a predetermined amount of time as determined by the timer circuit.

2. A power tool according to claim 1, wherein the timer circuit is an adjustable timer circuit.

3. A power tool according to claim 1, wherein the timer circuit has a delay period that can be adjusted by the operator.

4. A power tool according to claim 1, wherein the timer circuit comprises:

a varistor, a capacitor coupled to the varistor and the power supply and a transistor coupled to the varistor and the capacitor, wherein activation of the timer circuit causes the power supply to energize the capacitor and turn on the transistor when the capacitor reaches the threshold voltage of the transistor and wherein the varistor discharges the capacitor.

5. A power tool according to claim 4, wherein the switch is a single stage, on/off switch, the light source comprises at least one light emitting diode, the power supply is at least one rechargeable battery and the timer circuit is adapted to turn off the light at a predetermined amount of time after the switch has been deactivated.

6. A power tool according to claim 1, wherein the light source comprises at least one light emitting diode.

7. A power tool according to claim 1, wherein the power supply comprises at least one rechargeable battery.

8. A power tool according to claim 1, wherein the timer circuit comprises a microprocessor, wherein the microprocessor comprises a memory for storing a time delay value.

9. A power tool according to claim 8, wherein the microprocessor is programmable by the operator.

10. A power tool according to claim 1, wherein the switch is a one stage, on/off switch, the light source comprises at least one light emitting diode and the power supply comprises at least one rechargeable battery.

11. A power tool as in claim 1, wherein the switch is a single stage, on/off switch.

12. A power tool as in claim 1, wherein the timer circuit is adapted to be adjustable by a power tool user during a power tool operation.

13. A power tool comprising:

a motor, a switch coupled to the motor, the switch being capable of activation and deactivation by an operator, and a timer circuit coupled to the motor, the switch and a power source, wherein deactivation of the motor by the switch activates the timer circuit, the timer circuit in communication with an electrical device, the timing circuit controlling duration of the electrical device operation.

14. A power tool according to claim 13, wherein the timer circuit is an adjustable timer circuit.

15. A power tool according to claim 13, wherein the timer circuit comprises:

a varistor, a capacitor coupled to the varistor and the power supply and a transistor coupled to the varistor and the capacitor, wherein activation of the timer circuit causes the power supply to energize the capacitor and turn on the transistor when the capacitor reaches the threshold voltage of the transistor and wherein the varistor discharges the capacitor.

16. A power tool according to claim 13, wherein the timer circuit comprises a microprocessor, wherein the microprocessor comprises a memory for storing a time delay value.

17. A power tool according to claim 16, wherein the microprocessor is programmable by the operator.

18. A power tool as in claim 13, wherein the switch is a single stage, on/off switch.

19. A power tool according to claim 13, further comprising a light that is activated and deactivated by the timer circuit, wherein the timer circuit is an adjustable timer circuit and comprises:

a varistor, a capacitor coupled to the varistor and the power supply and a transistor coupled to the varistor and the capacitor, wherein activation of the timer circuit causes the power supply to energize the capacitor and turn on the transistor when the capacitor reaches the threshold voltage of the transistor and wherein the varistor discharges the capacitor.

20. A power tool according to claim 13, further comprising a light that is activated and deactivated by the timer circuit, wherein the timer circuit is an adjustable timer circuit comprising a microprocessor, wherein the microprocessor comprises a memory for storing a time delay value and the microprocessor is programmable by the operator.

21. A power tool comprising:

a motor, means for supplying current to the motor, a manually-operable switch electrically coupling the motor to the current supplying means when the switch is activated and electrically disconnecting the motor from the current supplying means when the switch is deactivated, and a timer circuit electrically coupled to the switch and an electrical device, wherein the timer circuit is arranged and constructed to cause current to be supplied to the electrical device for a predetermined period of time after the switch has been deactivated.

22. A power tool as in claim 21, further comprising means for adjusting the predetermined period of time that the timer circuit causes current to be supplied to the electrical device after the switch has been deactivated.

23. A power tool as in claim 21, wherein tie electrical device is a light and the timer circuit is arranged and constructed to control the predetermined period of time that the light is illuminated after the switch deactivates the motor.

24. A power tool as in claim 23, further comprising means for adjusting the predetermined period of time that the light is illuminated after the switch deactivates the motor.

25. A power tool comprising:

a motor, means for supplying current to the motor, a manually-operable switch electrically coupling the motor to the current supplying means when the switch is activated and electrically disconnecting the motor from the current supplying means when the switch is deactivated, and means for energizing an electrical device for a predetermined period of time after the switch has been deactivated.

26. A power tool as in claim 25, further comprising means for adjusting the predetermined period of time that the electrical device is energized after the switch has been deactivated.

* * * * *

US006511200C1

(12) EX PARTE REEXAMINATION CERTIFICATE (8259th)

United States Patent
Matsunaga

(10) Number: US 6,511,200 C1
(45) **Certificate Issued: *May 24, 2011**

(54) POWER TOOLS HAVING TIMER DEVICES

(75) Inventor: Yutaka Matsunaga, Yokkaichi (JP)

(73) Assignee: Makita Corporation, Anjo-shi, Aichi-ken (JP)

Reexamination Request:
No. 90/010,764, Dec. 10, 2009

Reexamination Certificate for:

| | |
|---|---|
| Patent No.: | **6,511,200** |
| Issued: | **Jan. 28, 2003** |
| Appl. No.: | **09/954,381** |
| Filed: | **Sep. 12, 2001** |

( * ) Notice: This patent is subject to a terminal disclaimer.

Related U.S. Application Data

(63) Continuation of application No. 09/605,517, filed on Jun. 28, 2000, now Pat. No. 6,318,874.

(30) Foreign Application Priority Data

Jul. 13, 1999 (JP) ..... 11-199584

(51) Int. Cl.
*B25B 23/18* (2006.01)

(52) U.S. Cl. ..... 362/119; 362/276; 362/802; 315/360

(58) Field of Classification Search ..... 362/119
See application file for complete search history.

(56) References Cited

U.S. PATENT DOCUMENTS

| | | | |
|---|---|---|---|
| 2,310,166 | A | 2/1943 | Way |
| 2,525,588 | A | 10/1950 | Cameron |
| 4,642,738 | A | 2/1987 | Meller |
| 5,412,546 | A | 5/1995 | Huang |

FOREIGN PATENT DOCUMENTS

| | | | |
|---|---|---|---|
| DE | 3 831 344 | A1 | 3/1990 |
| JP | 10-34564 | A | 2/1998 |
| JP | 11-111002 | A | 4/1999 |

*Primary Examiner*—Minh T Nguyen

(57) ABSTRACT

Power tools are taught having a motor M1, a tool 1 coupled to the motor M1 via a tool holder 2, at least one light 4 disposed proximal to the tool 1, a switch 6 coupled to the motor M1 and the light 4, the switch 6 being capable of activation by an operator, a power supply 7 coupled to the switch 6, and a timer circuit 3 coupled to the light 4, the switch 6 and the power supply 7. Preferably, activation of the switch 6 causes the motor M1 and the light 4 to operate and the timer circuit 3 causes the light 4 to remain lit for a predetermined amount of time after either (1) the switch 6 has been activated or (2) the switch 6 has been deactivated subsequent to being activated. The timer circuit 3 can be, for example, a RC timer circuit 11 or a microprocessor 15. The light 4 may be an LED. The power supply 7 can be a rechargeable battery Ba.

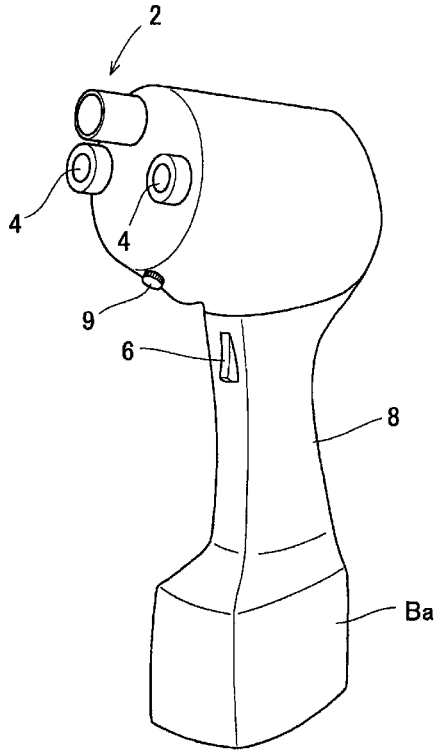

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 4-5, 15-17, 19-20 and 25-26 are cancelled.

Claims 1, 13 and 21 are determined to be patentable as amended.

Claims 2-3, 6-12, 14, 18 and 22-24, dependent on an amended claim, are determined to be patentable.

1. A power tool comprising:

a tool housing, a motor disposed within the tool housing, a light source disposed on the tool housing, a switch coupled to the motor and the light source, the switch [being] capable of activation *into an ON state* and deactivation *into an OFF state* by an operator, and a timer circuit coupled to the light source, the switch and a power supply, wherein when the power tool is activated [or deactivated] *by activation of the switch into the ON state* the light source remains on for a predetermined amount of time as determined by the timer circuit *regardless of whether the switch remains in the ON state or is deactivated into the OFF state*.

13. A power tool comprising:

a motor, a switch coupled to the motor, the switch [being] capable of activation and deactivation by an operator, and a timer circuit coupled to the motor, the switch and a power source, wherein deactivation of the motor by the switch activates the timer circuit, the timer circuit in communication with an electrical device, the [timing] *timer* circuit controlling duration of the electrical device operation*, and*

*the timer circuit comprises:*

*a varistor,*

*a capacitor coupled to the varistor and the power supply, and*

*a transistor coupled to the varistor and the capacitor,*

*wherein the capacitor is energized when the switch is activated, the transistor turns on when voltage across the capacitor reaches a threshold voltage of the transistor, the capacitor is discharged via the varistor when the switch is deactivated and the transistor turns off when the voltage across the capacitor falls below the threshold voltage of the transistor.*

21. A power tool comprising:

a motor, means for supplying current to the motor, a manually-operable switch electrically coupling the motor to the current supplying means when the switch is activated and electrically disconnecting the motor from the current supplying means when the switch is deactivated, and a timer circuit electrically coupled to the switch and an electrical device, wherein the timer circuit is arranged and constructed to cause current to be supplied to the electrical device for a predetermined period of time after the switch has been deactivated*, and*

*the timer circuit comprises:*

*a varistor,*

*a capacitor coupled to the varistor and the power supply, and*

*a transistor coupled to the varistor and the capacitor,*

*wherein the capacitor is energized when the switch is activated, the transistor turns on when voltage across the capacitor reaches a threshold voltage of the transistor, the capacitor is discharged via the varistor when the switch is deactivated and the transistor turns off when the voltage across the capacitor falls below the threshold voltage of the transistor.*

* * * * *